US007160050B2

(12) United States Patent
Meyers

(10) Patent No.: US 7,160,050 B2
(45) Date of Patent: Jan. 9, 2007

(54) LOCKABLE MANHOLE COVER

(76) Inventor: William G. Meyers, 1390 W. 275 N., Angola, IN (US) 46703

( * ) Notice: Subject to any disclaimer, the term of this patent is extended or adjusted under 35 U.S.C. 154(b) by 0 days.

(21) Appl. No.: 11/103,876

(22) Filed: Apr. 12, 2005

(65) Prior Publication Data

US 2005/0232695 A1 Oct. 20, 2005

Related U.S. Application Data

(60) Provisional application No. 60/561,735, filed on Apr. 13, 2004.

(51) Int. Cl.
*E02D 29/14* (2006.01)

(52) U.S. Cl. ..... 404/25

(58) Field of Classification Search ..... 404/25; 52/19; 137/371
See application file for complete search history.

(56) References Cited

U.S. PATENT DOCUMENTS 4,281,944 A * 8/1981 Bowman ..... 404/26
4,597,692 A * 7/1986 Gruenwald ..... 404/25
4,890,425 A * 1/1990 Mamula ..... 52/19
4,925,337 A * 5/1990 Spiess et al. ..... 404/26
5,063,996 A * 11/1991 Kenner ..... 166/75.11
5,324,135 A * 6/1994 Smith ..... 404/25
5,628,152 A * 5/1997 Bowman ..... 52/20
5,966,876 A * 10/1999 Neathery et al. ..... 52/20
5,974,741 A * 11/1999 Fukuhara ..... 52/20
6,007,270 A * 12/1999 Bowman ..... 404/25
6,752,565 B1 6/2004 Schrage ..... 404/25
6,769,834 B1 * 8/2004 Stange ..... 404/25
6,886,577 B1 * 5/2005 Phillips et al. ..... 137/15.01

* cited by examiner

*Primary Examiner*—Gary S Hartmann
(74) *Attorney, Agent, or Firm*—Taylor & Aust, P.C.

(57) ABSTRACT

A manhole system including a cover, a frame receiving the cover and at least one security device securing the cover to the frame.

10 Claims, 13 Drawing Sheets

LOCKABLE MANHOLE COVER

CROSS REFERENCE TO RELATED APPLICATIONS

This is a non-provisional application based upon U.S. provisional patent application Ser. No. 60/561,735, entitled "LOCKABLE MANHOLE COVER", filed Apr. 13, 2004.

BACKGROUND OF THE INVENTION

1. Field of the Invention

The present invention relates to a manhole cover assembly, and, more particularly, to a manhole security system.

2. Description of the Related Art

Access to underground sewer and utility systems are typically governed by removal of a manhole cover to gain entry to the utility. Examples of manhole covers include concrete that is shaped to cover a hole, the removal of which allows access to the underground system. Metal manhole cover systems, typically of cast iron having a circularly shaped cover, are commonly used to provide access to the underground system. Even though the weight of the manhole cover can exceed 100 lbs, the weight itself is not sufficient deterrent to prevent access by those that are not authorized to gain access.

One system of security, often utilized when high ranking dignitaries are to take a specified street route, includes the welding of manhole covers to their frames to prevent the underground system from being utilized by individuals wishing to gain access to the intended travel route. Another method of securing manhole covers is to utilize pad locks, which leads to logistical problems relative to the administrative burden of tracking keys for the locks.

Yet another method used to secure manholes is to use bolts with specially shaped heads that require special sockets or wrenches that correspond to the shaped heads for both installation and removal. These have the disadvantage of requiring the special tool for the installation and that they can be removed and replaced without any evidence of access to the underground system.

In a culture where terrorists can strike or rowdy celebrants may remove covers to disrupt traffic flow a cost effective security method for locking manhole covers is needed.

SUMMARY OF THE INVENTION

The present invention, in one form thereof, comprises a manhole system including a cover, a frame receiving the cover and at least one security device securing the cover to the frame.

The present invention, in another form thereof, comprises a method of securing a manhole cover including the steps of placing a portion of a security device proximate to a slot in a manhole frame; positioning a manhole cover on the manhole frame; inserting a shaft of the security device through an opening in the manhole cover; and securing a portion of the shaft in a female portion of the security device.

An advantage of the present invention is that the security device is a low cost replaceable item.

Yet another advantage of the present invention is that a special tool is required to remove the security device once it is installed.

Still yet another advantage of the present invention is that the security device can be installed without the need for any specialized tools.

Yet another advantage of the present invention is that tampering of the security device is easily detectable.

Yet another advantage of the present invention is that the security device can be easily replaced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
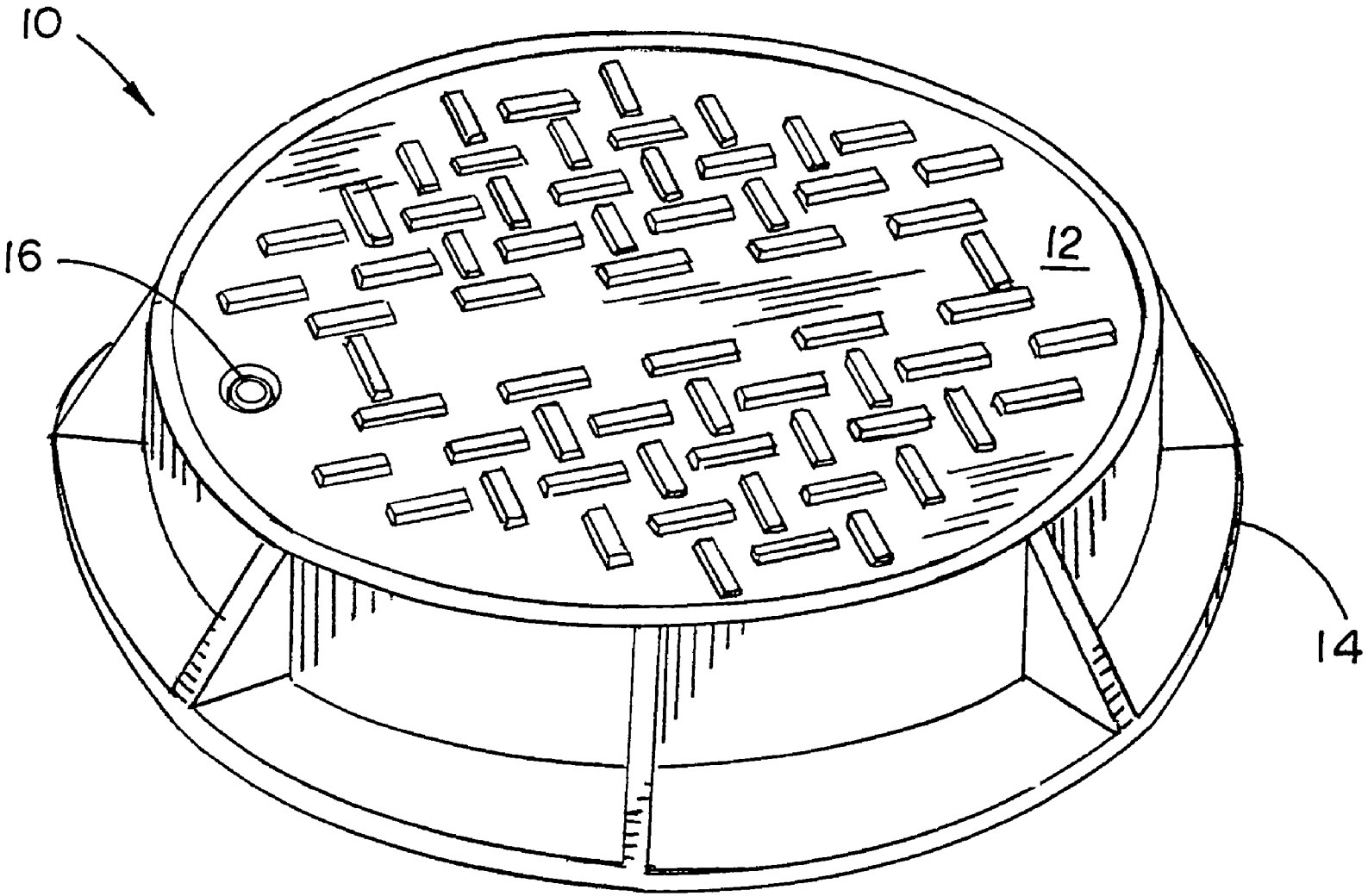
FIG. 1 is a perspective view of an embodiment of a manhole security system of the present invention.
Figure 2:
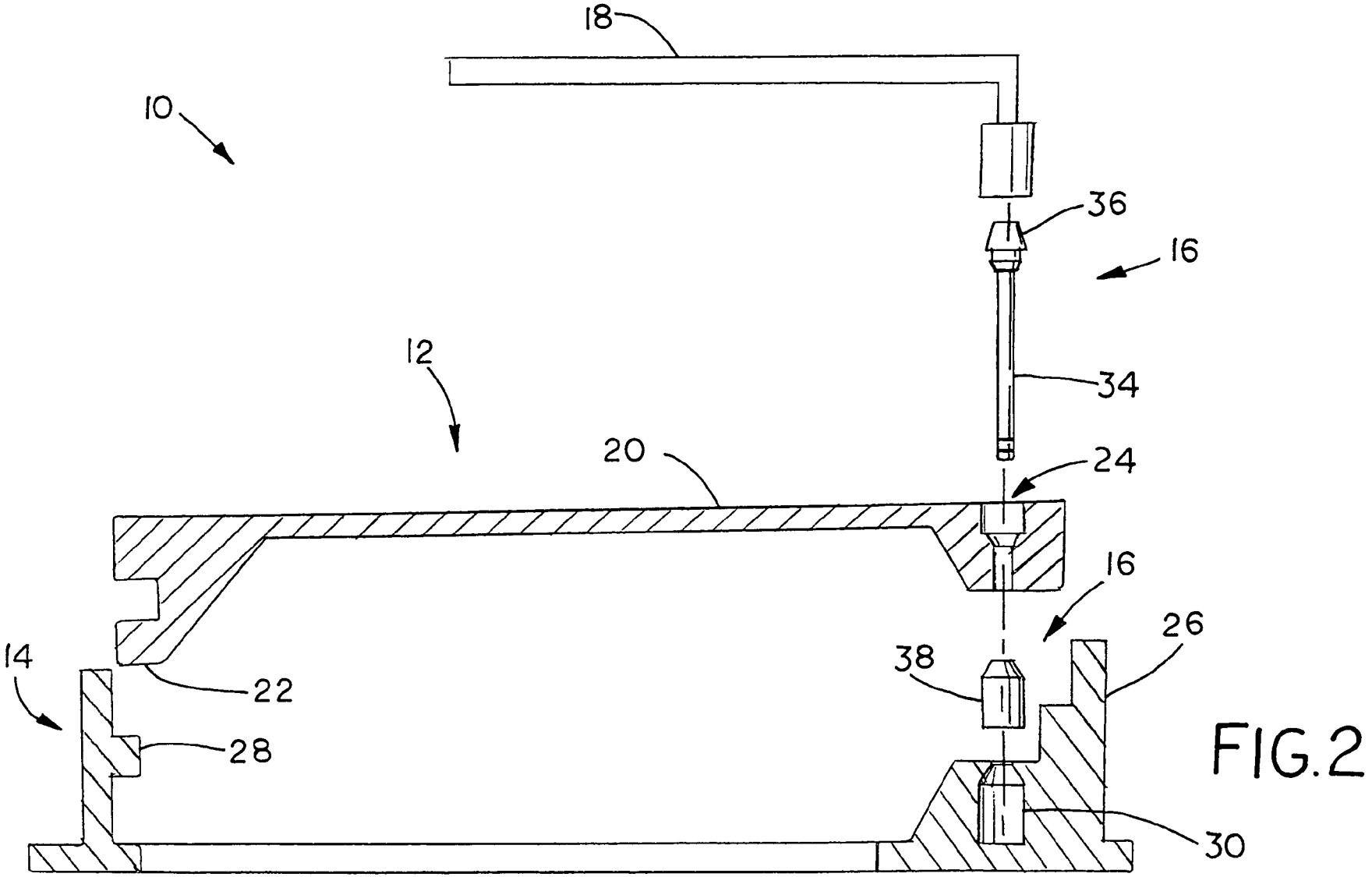
FIG. 2 is a partially sectioned side view of the manhole security system of FIG. 1.

Referring now to the drawings, and more particularly to FIGS. 1–5, there is illustrated a manhole system 10 including manhole cover 12, a manhole frame 14, a security device 16 and a removal tool 18. Manhole system 10 is illustrated utilizing one security device 16, also known as a barrier seal 16, but more than one barrier seal 16 may be utilized to secure manhole cover 12 to manhole frame 14.

Figure 3:
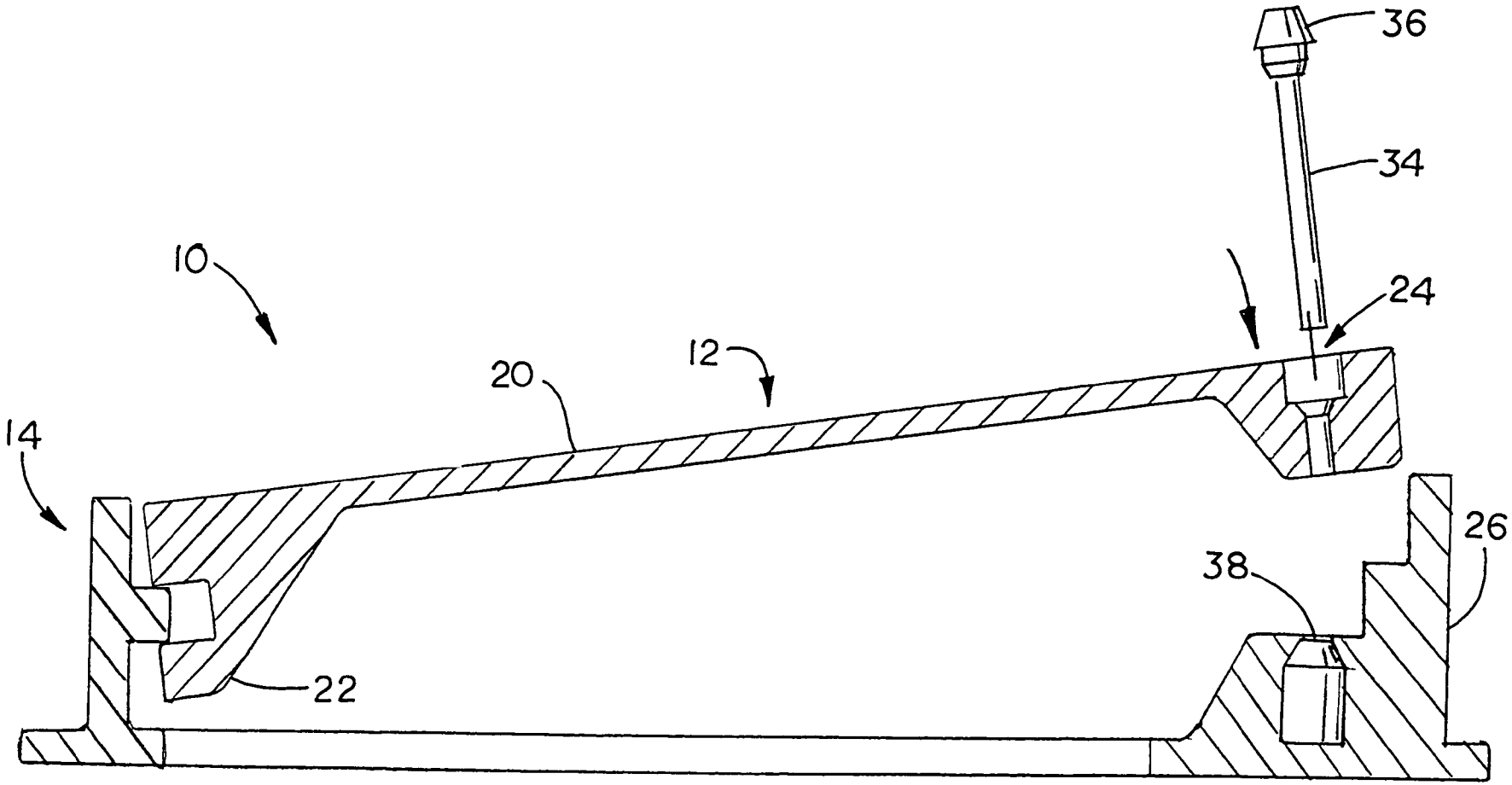
FIG. 3 is another partially section side view of the manhole security system of FIGS. 1 and 2.
Figures 4, 5:
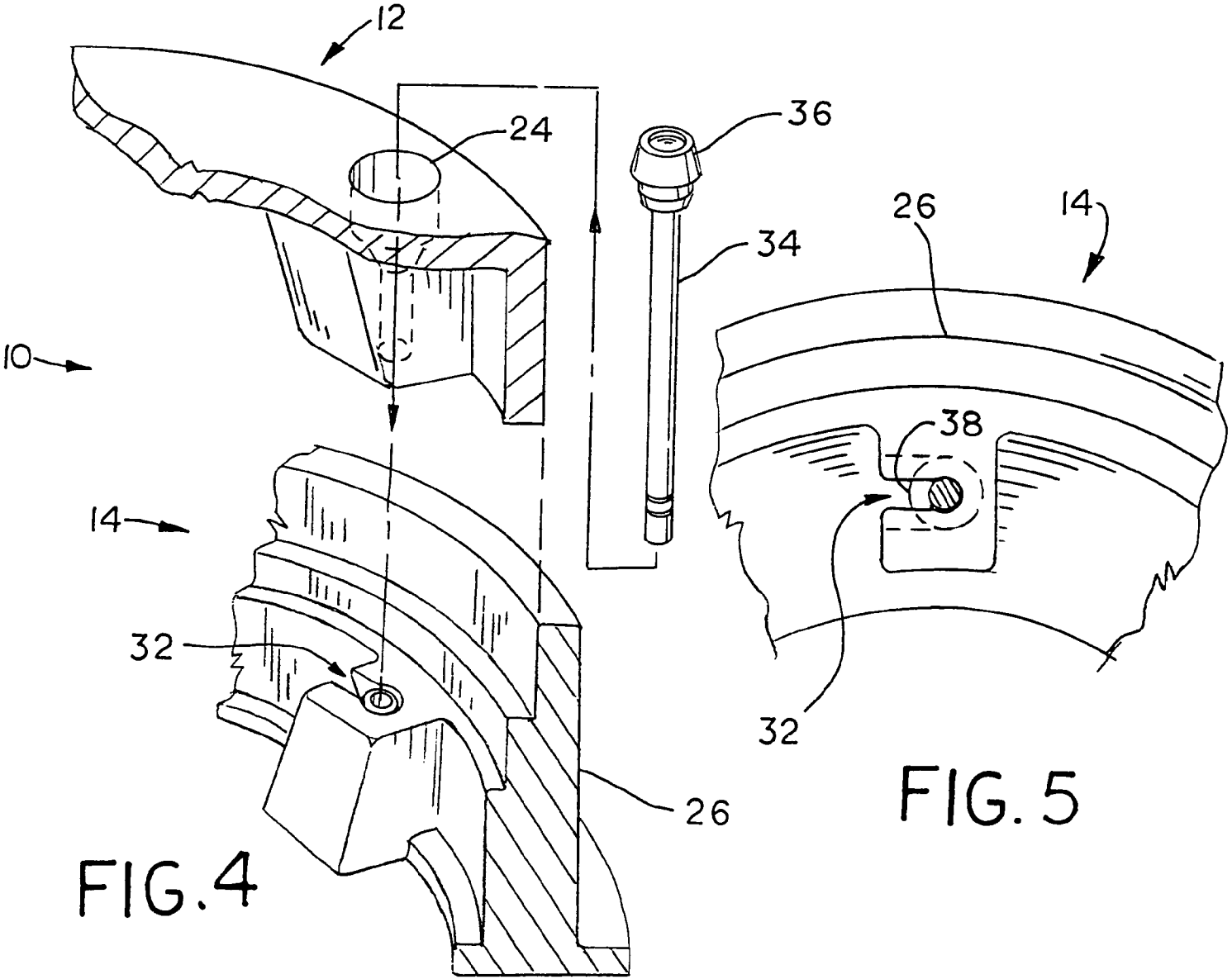
FIG. 4 is a perspective partially sectioned view of manhole security system of FIGS. 1–3.
FIG. 5 is a partial view of manhole cover frame of the manhole security system of FIGS. 1–4.

Manhole cover 12 includes a body 20, at least one lip 22, and a recessed hole 24. Body 20 is made from a high strength material, such as cast iron or steel. Associated with body 20 is a lip 22, also known as a protrusion 22 that interacts with a protrusion on manhole frame 14 to secure manhole cover 12 along one side of manhole cover 12 and manhole frame 14. As can be seen in FIG. 3, lip 22 engages the protrusion on manhole frame 14. Recessed hole 24 is shaped to allow barrier seal 16 to be inserted therethrough and to be seated in a recessed manner.

Manhole frame 14 includes outer wall 26, a lip 28, a security pocket 30 and a slot 32. Outer wall 26 interfaces with paving material and/or concrete which typically surrounds manhole frame 14. Lip 28 co-acts with lip 22 to secure one portion of manhole cover 12 to manhole frame 14. Manhole cover 12 is positioned so that lip 22 goes underneath lip 28 as manhole cover 12 is pivoted into position in manhole frame 14. Security pocket 30 allows for the insertion of a portion of barrier seal 16 therein. The insertion of the portion of barrier seal 16 is illustrated as being slid into security pocket 30. A slot 32 is associated with security pocket 30 and allows for the removal of the portion of barrier seal 16 that is attached thereto upon the removal of manhole cover 12.

Figure 6:
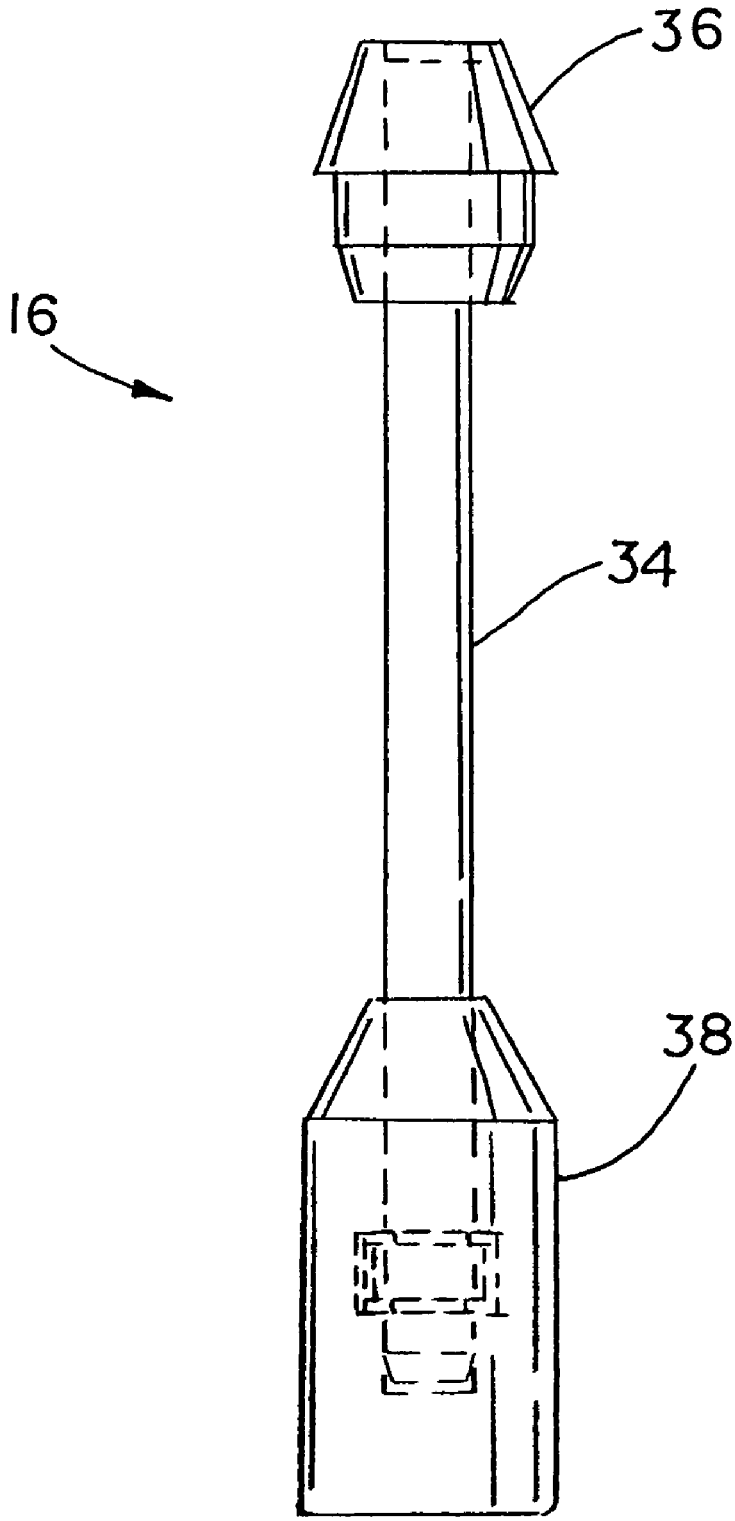
FIG. 6 is a view of the security device utilized in the manhole security system of FIGS. 1–5.

Now, additionally referring to FIG. 6 there is shown a barrier seal 16 that includes a shaft 34, a head 36 and a lock body 38. Head 36 may be swaged to shaft 36 or permanently attached to shaft 34. Shaft 34 is inserted into lock body 38 which locks onto shaft 34, preventing the retraction of shaft 34 from lock body 38. Shaft 34 is a male portion of barrier seal 16 which is inserted into lock body 38, which is also known as the female portion of barrier seal 16. In order to separate portions of barrier seal 16, destructive force must be applied. One method of separating barrier seal 16 is for a severing device to severe shaft 34, usually proximate to head 36, thereby allowing manhole cover 12 to separate from manhole frame 14. An alternate method of separating barrier seal 16 is for a hydraulic force to be applied to head 36 and shaft 34 to remove head 36 from shaft 34. This method of removal is illustrated with a head 36 being removably connected to shaft 34 and having an opening through the top of head 36. Head 36 is removed only with the application of significant force, normally exceeding 2,000 pounds. Although lock body 38 is shown as having a blind cavity accommodating a portion of shaft 34, the hole or cylindrical opening may extend completely through lock body 38. This advantageously allows shaft 34 to be pushed on through lock body 38, so that lock body 38 may be reused. Lock body 38 is configured so that shaft 34 may only enter and not be retracted therefrom. Shaft 34 and head 36 are collectively referred to as a bolt, because of its resemblance thereto. Additionally, barrier seals 16 may be serialized and records kept as too which serial number has secured which cover.

Figure 7:
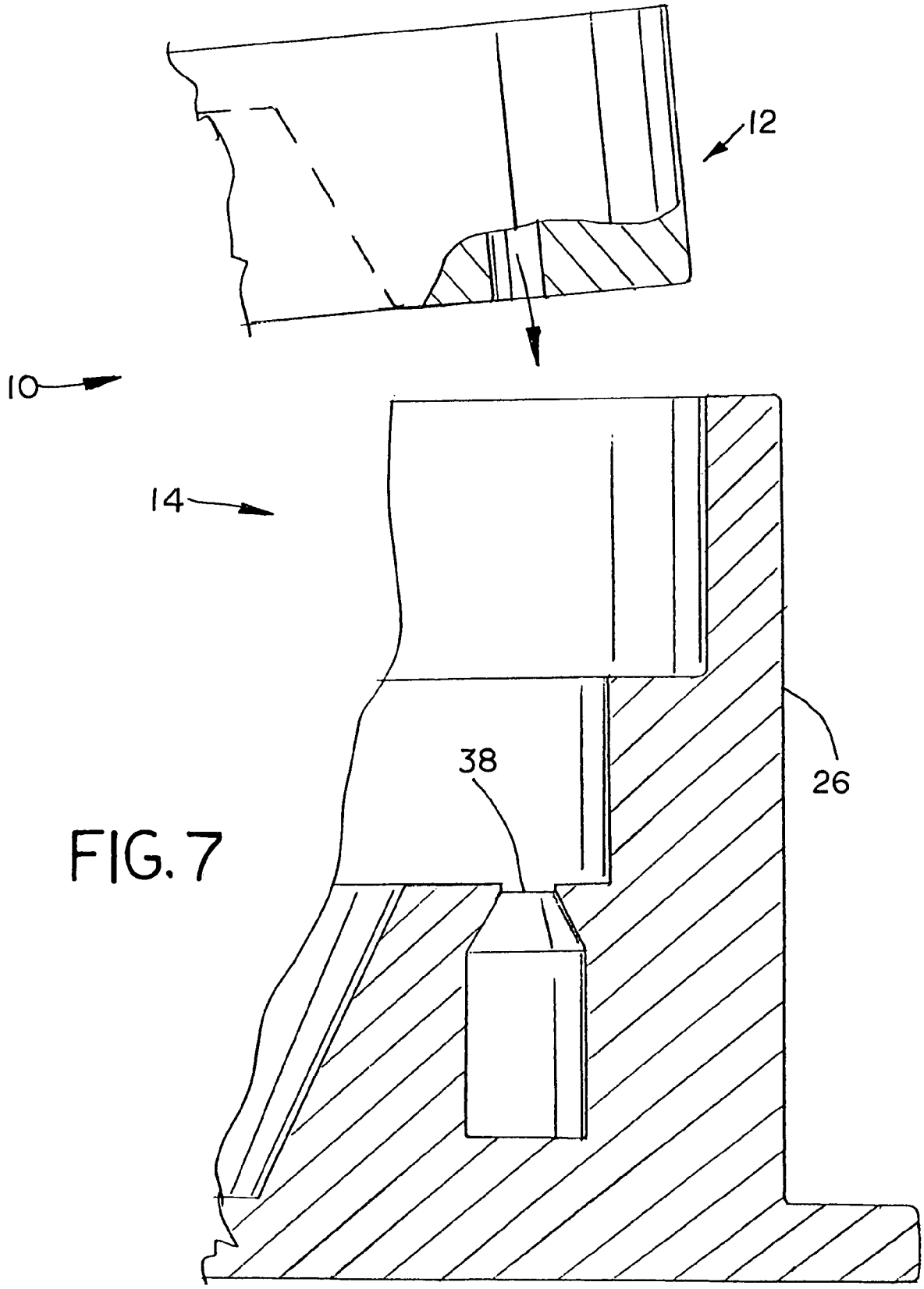
FIG. 7 is a partially sectioned side view of the manhole security system of FIGS. 1–6.
Figure 8:
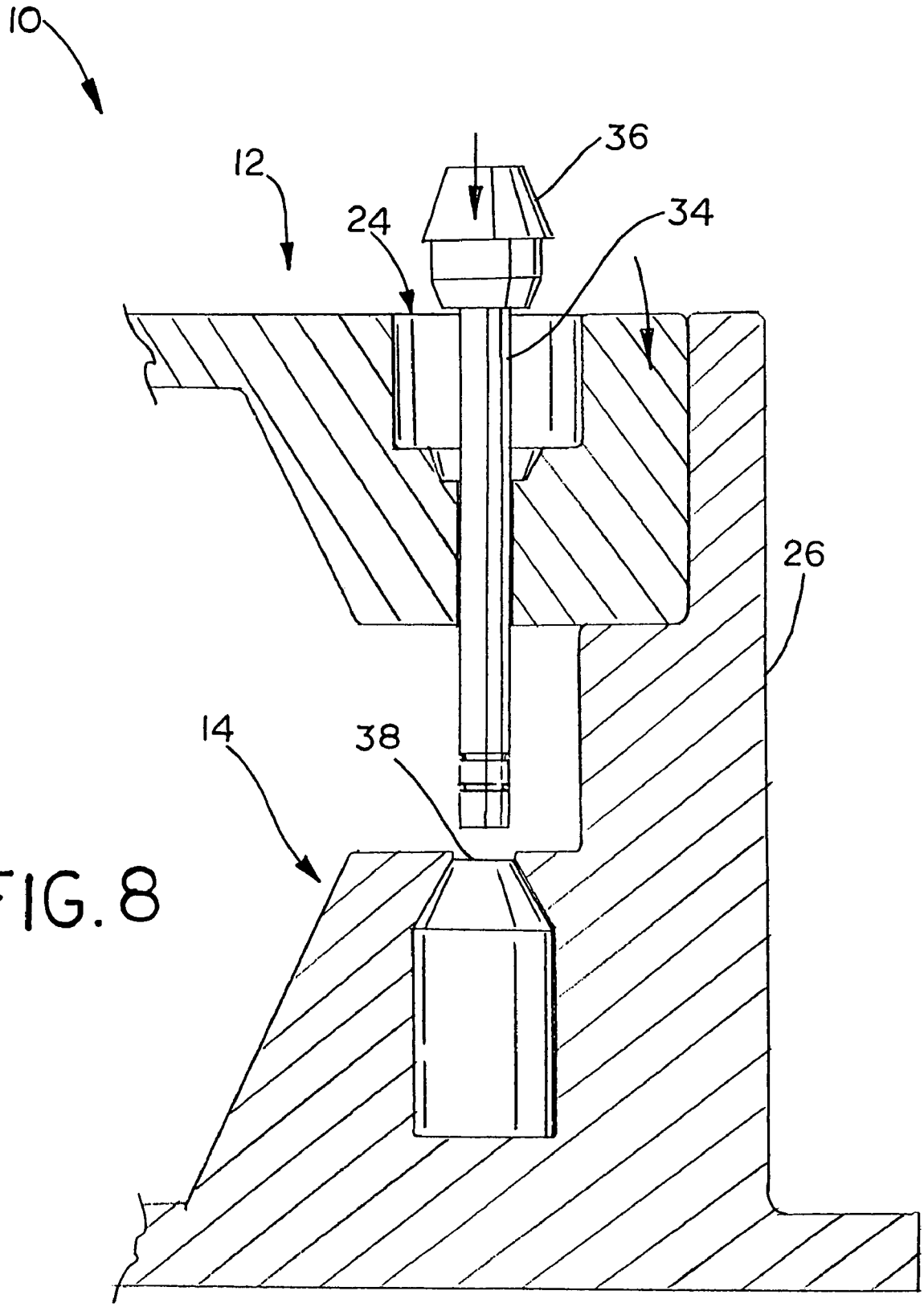
FIG. 8 is a partially sectioned side view of the installation of a security device in the manhole security system of FIGS. 1–7.
Figure 9:
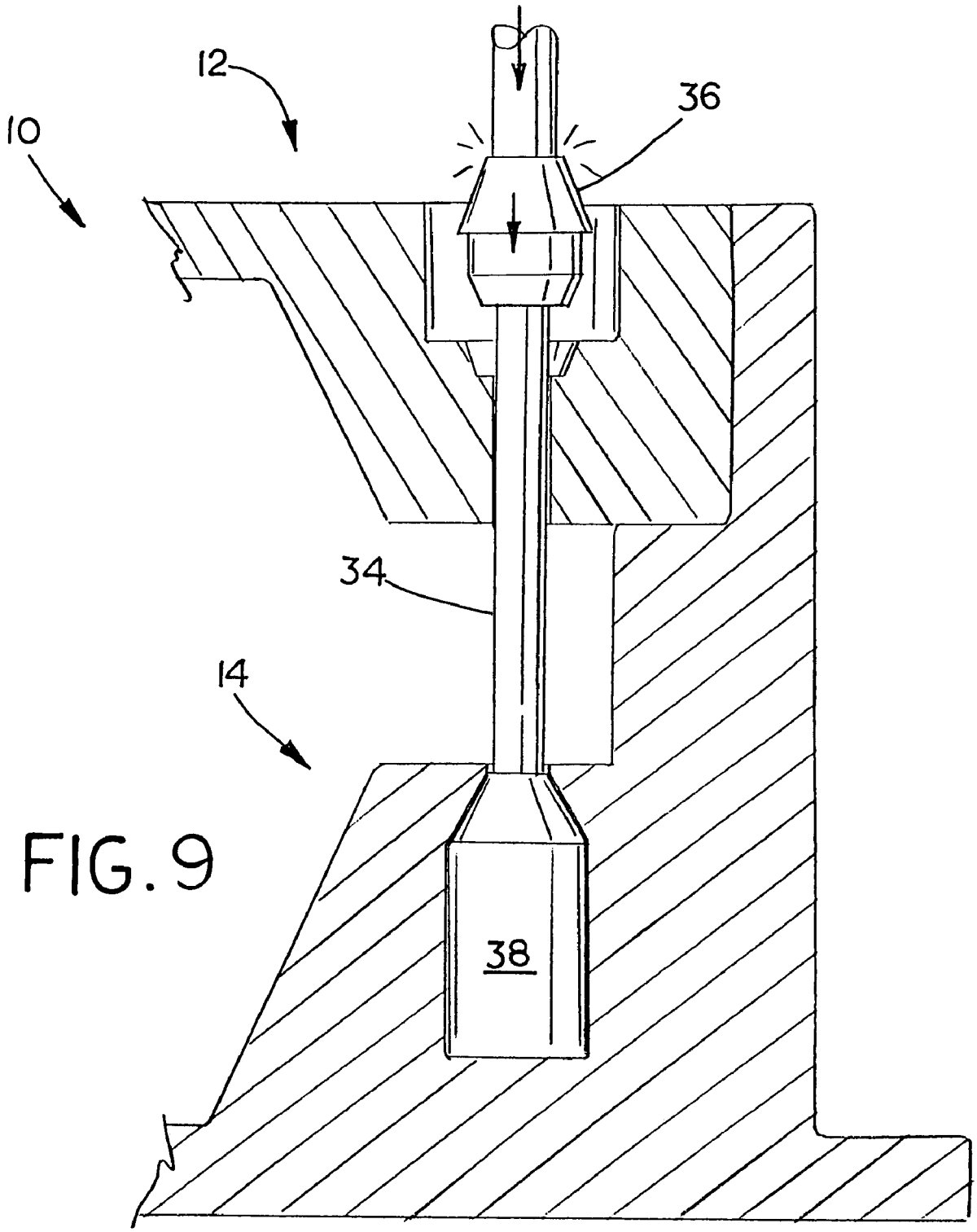
FIG. 9 is a partially sectioned side view of the installation of a security device in the manhole security system of FIGS. 1–8.
Figure 10:
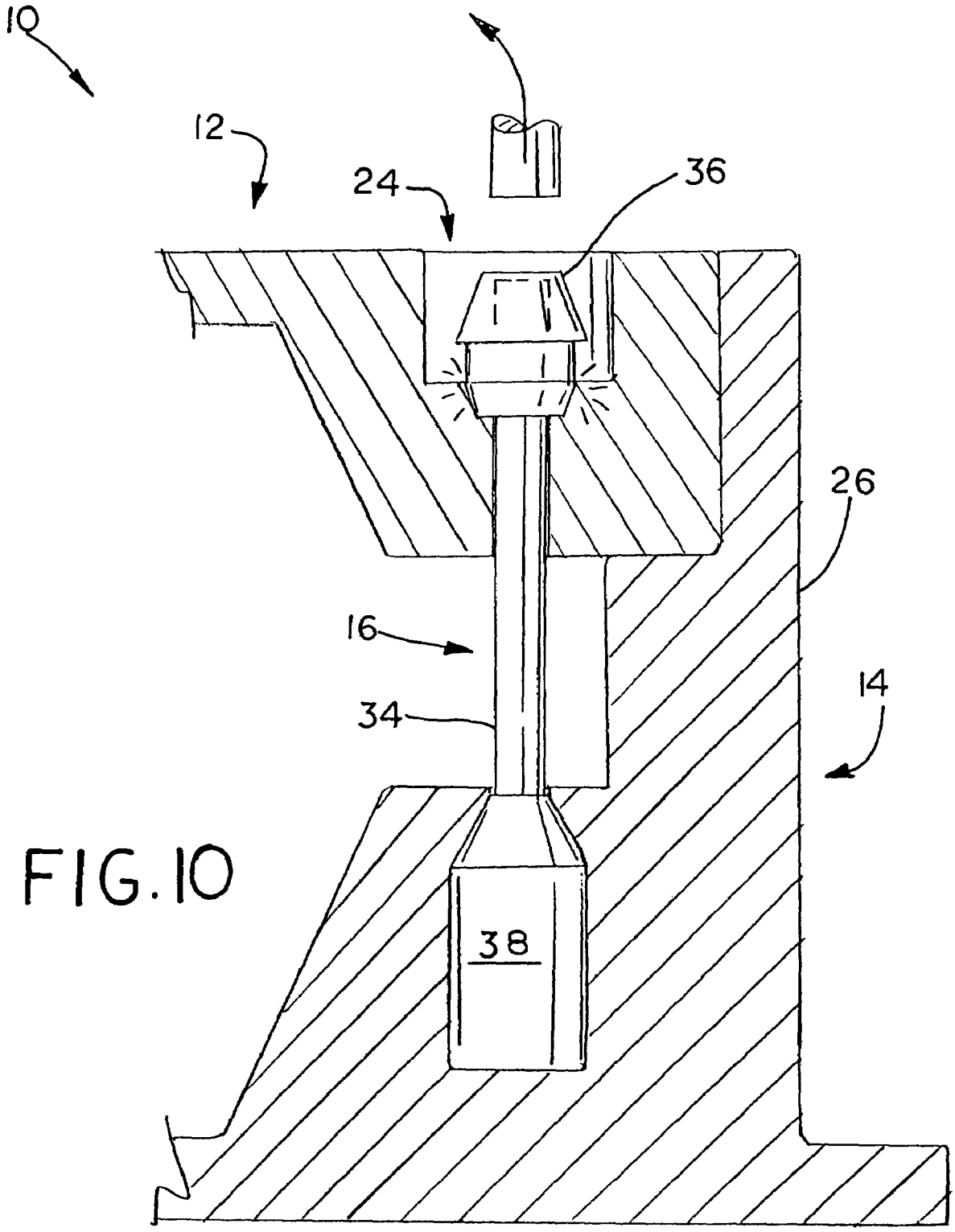
FIG. 10 is a partially sectioned side view of the installation of a security device in the manhole security system of FIGS. 1–9.

Now, referring to FIGS. 7–14, there is illustrated a method of assembly and disassembly of manhole system 10. In FIG. 7 there is illustrated lock body 38 having been positioned in security pocket 30 and manhole cover 12 is lowered onto manhole frame 14 aligning recessed hole 24 with a cylindrical opening in lock body 38. FIG. 8 illustrates that manhole cover 12 is in position on manhole frame 14 and shaft 34 of the bolt is slid through recessed hole 24 and approaches lock body 38. As shown in FIG. 9, a force is applied to head 36 forcing shaft 34 into lock body 38. Advantageously no special tooling is required for the installation of barrier seal 16 in manhole system 10. A mallet or hammer may be utilized to push shaft 34 into lock body 38. Once head 36 seats in recessed hole 24, as shown in FIG. 10, manhole system 10 is in a secure state.

Figure 11:
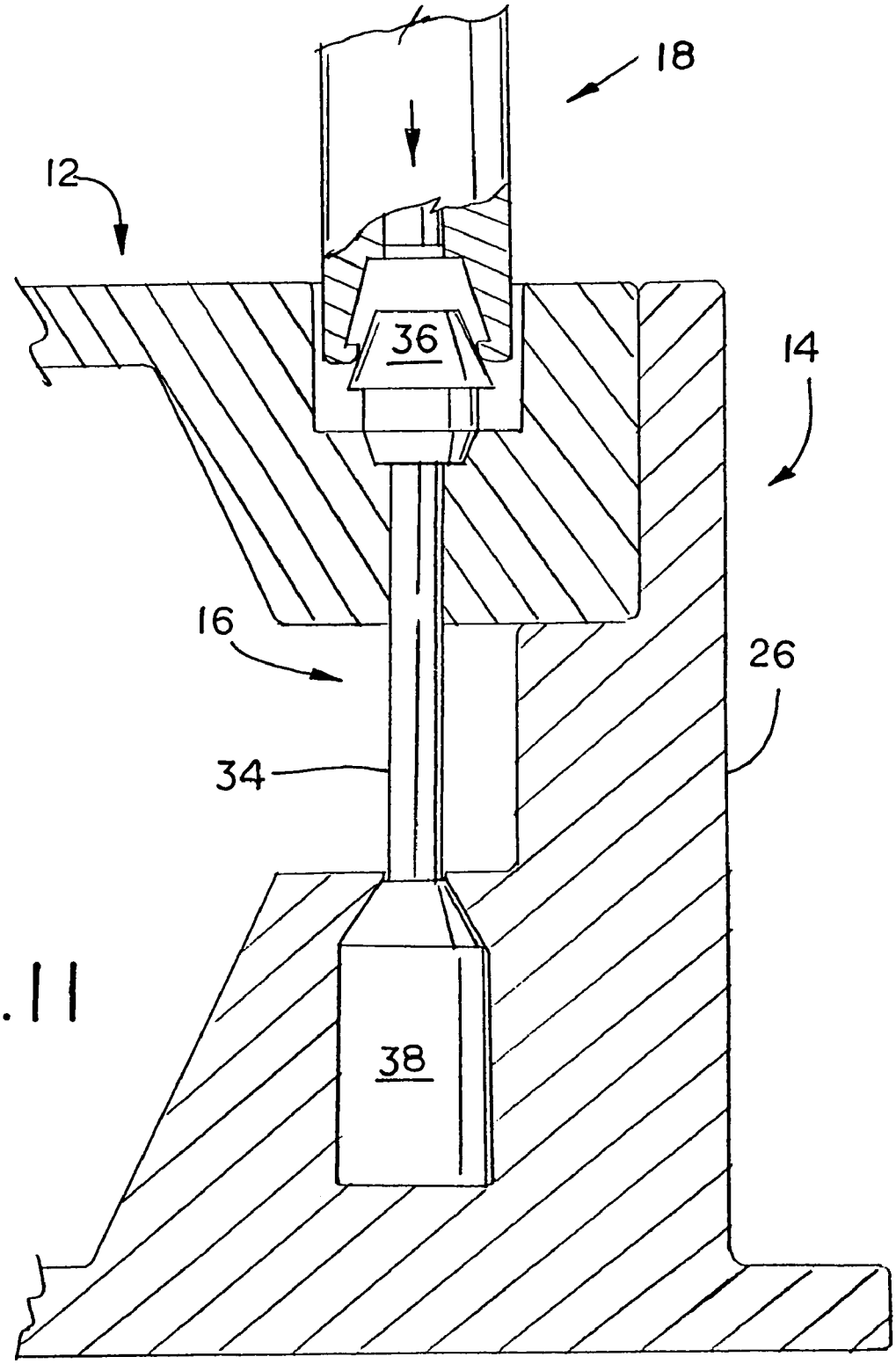
FIG. 11 is a partially sectioned side view of the manhole security system of FIGS. 1–10 illustrating a removal tool.
Figure 12:
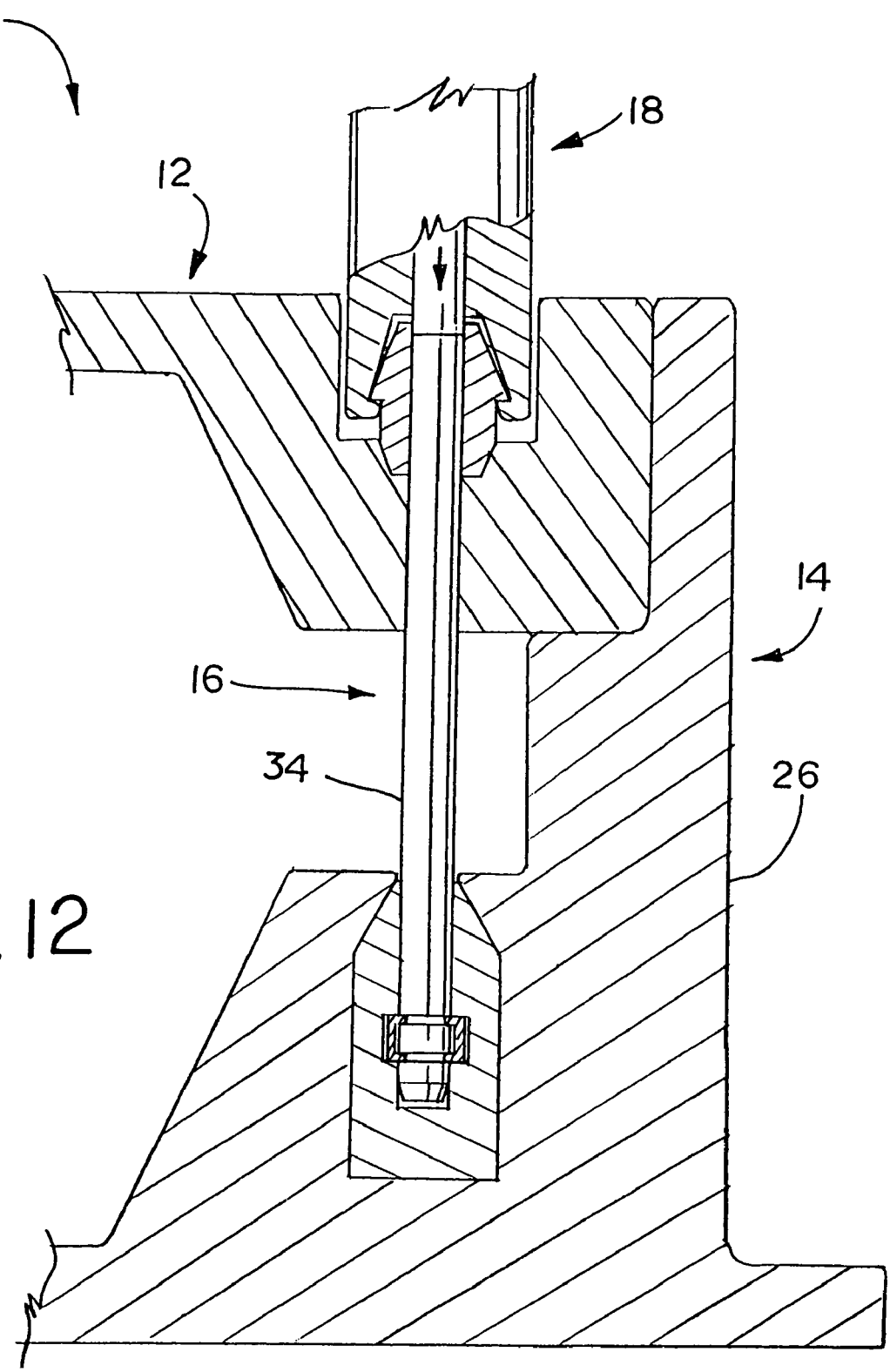
FIG. 12 is a partially sectioned side view illustrating the removal of the security device from the manhole security system of FIGS. 1–11.
Figure 13:
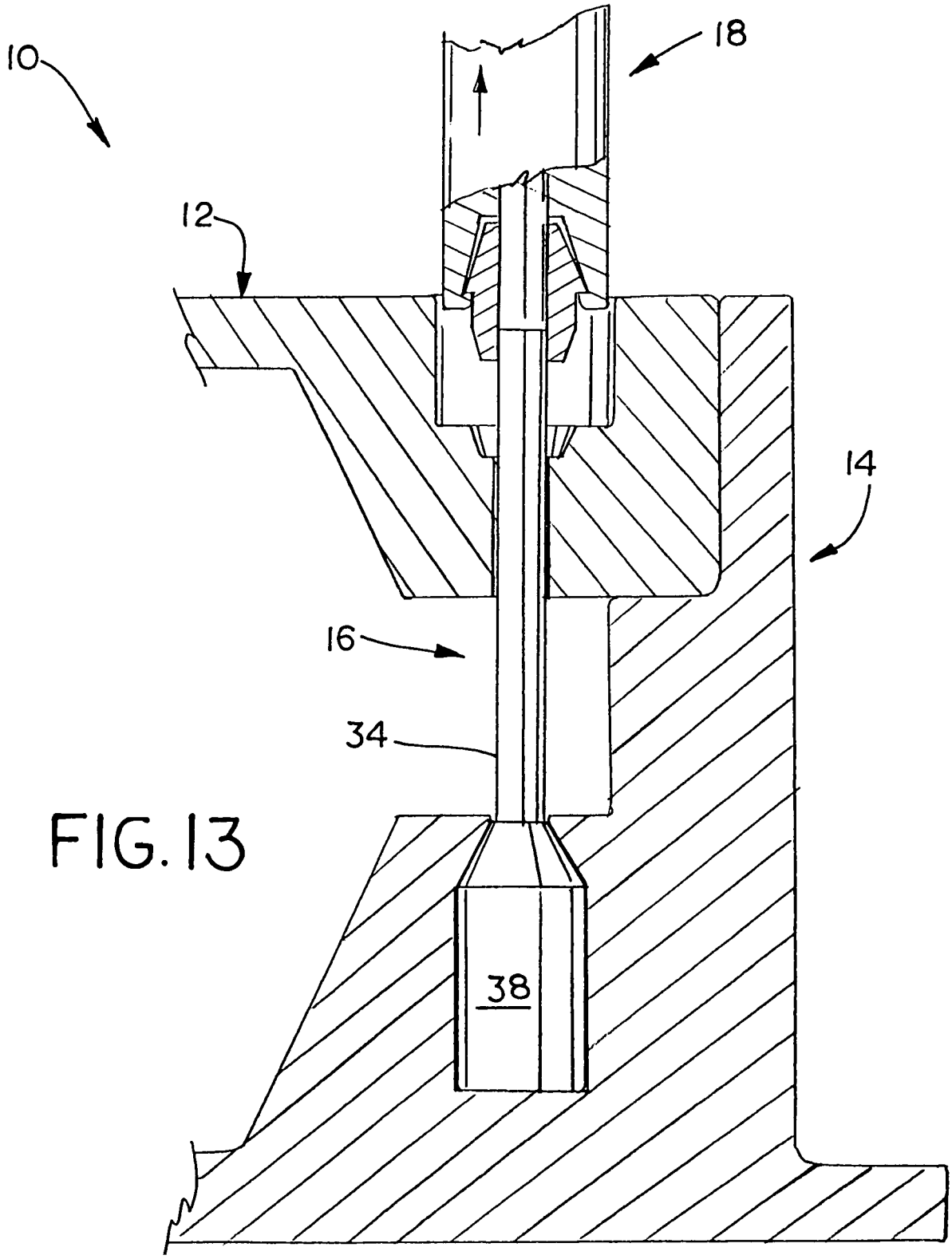
FIG. 13 is a partially sectioned side view illustrating the removal of the security device from the manhole security system of FIGS. 1–12.

FIG. 11 illustrates the insertion of a removal tool 18 over head 36 of barrier seal 16. Fingers of removal tool 18 engage a feature of head 36 in order to facilitate removal of head 36 from shaft 34. As shown in FIG. 12, pressure is applied against shaft 34 causing head 36 to be removed from shaft 34 as illustrated in FIG. 13. Once head 36 is removed from shaft 34, it gives a clear visual indication that manhole system 10 is no longer secure. Additionally, head 36 may have other indicia thereon to indicate that it has been tampered therewith. Once head 36 is removed it cannot easily be replaced onto shaft 34.

Figure 14:
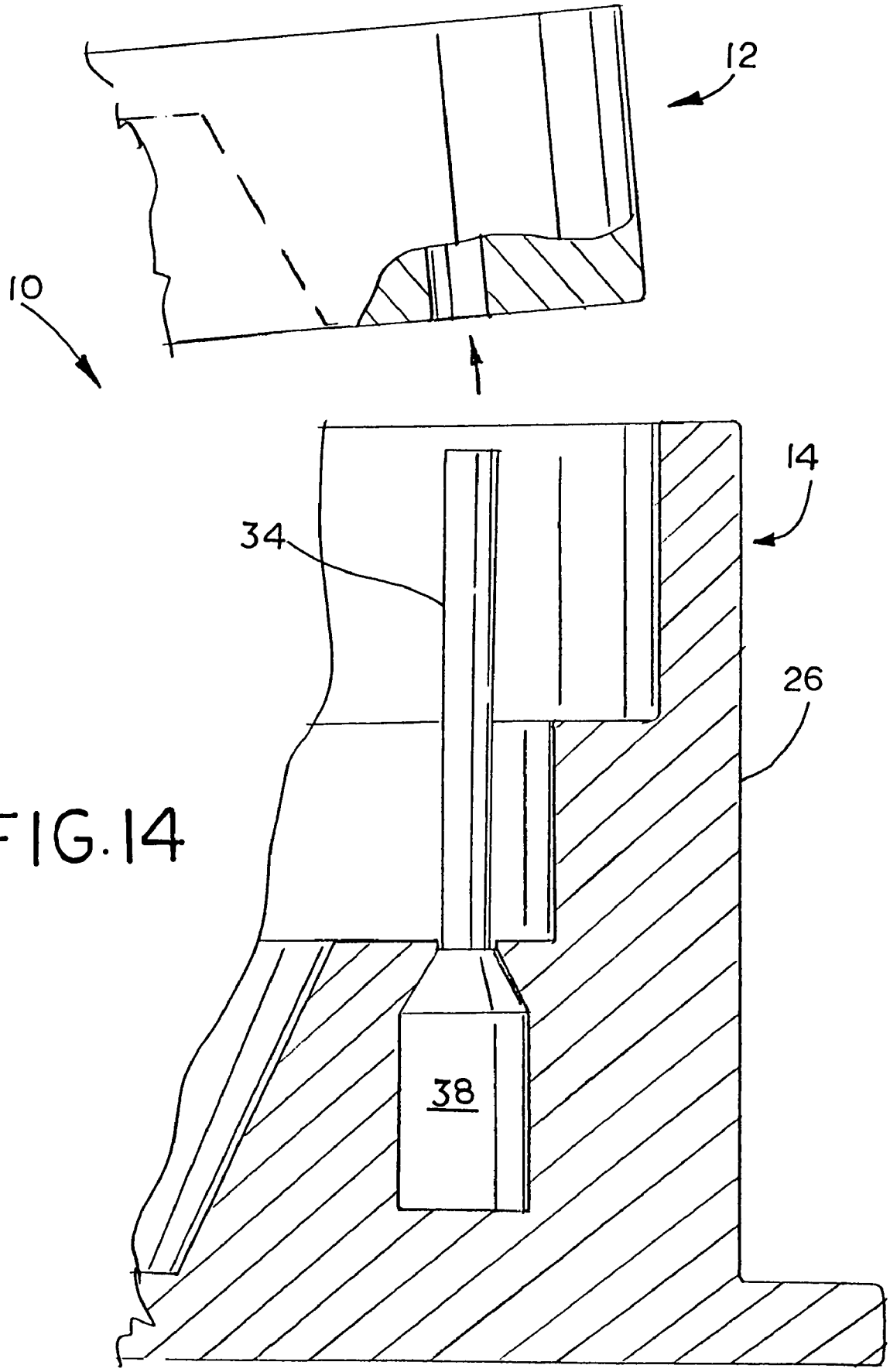
FIG. 14 illustrates removal of the manhole cover from the manhole security system of FIGS. 1–13.

As shown in FIG. 14, manhole cover 12 is pivoted away from manhole frame 14 and is removed therefrom. Shaft 34 is still connected to lock body 38 and is slid through slot 34 for the replacement of a new lock body 38 into security pocket 30, thereby allowing the reassembly and re-securing of manhole system 10.

As mentioned previously, barrier seal 16 is destructively removed thereby allowing access to manhole covered by manhole system 10. Barrier seal 16 is configured to withstand several thousand pounds of stress before failure. The requirement to utilize a special tool for the removal of barrier seal 16 makes it obvious to security personnel if the individual is removing the seal. Although barrier seal 16 has been illustrated as being a single straight shaft, alternate configurations are also anticipated including bent shafts, barrier seals having at least one flexible portion and variations thereon.

Advantageously, the present invention allows for the economical replacement of barrier seal 16 in a manhole system 10. The system advantageously allows for the easy insertion of the barrier seal, only requiring special tooling for the removal thereof.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A manhole system, comprising:

a cover;

a frame having an opening, said frame receiving said cover that closes said opening; and at least one security device securing said cover to said frame, said at least one security device being a barrier seal including:

a male portion: and a female portion receiving said male portion, said security device not releasing said male portion from said female portion without destruction of said security device.

2. The system of claim 1 wherein said frame includes a slotted portion for receiving one of said male portion and said female portion of said security device.

3. The system of claim 2, wherein said male portion includes: ahead; and a shaft, said cover having a hole therethrough, said shaft being inserted through said hole in said cover, said female portion being positioned proximate said slotted portion, said shaft traversing a portion of said slotted portion and engaging said female portion.

4. The system of claim 3, wherein said frame further includes a pocket in communication with said slotted portion, said pocket holding said female portion in position to receive said shaft.

5. The system of claim 1, wherein said frame includes a protrusion and said cover includes a protrusion, said protrusion of said frame interacting with said protrusion of said cover to retain a portion of said cover to said frame.

6. A secure manhole cover and manhole frame system, the cover covering a hole in the frame, comprising:

at least one security device securing the cover to the frame, the cover including at least one hole through which a corresponding one of said at least one security device traverses, said at least on security device including:

a male portion; and a female portion receiving said male portion, said security device not releasing said male portion from said female portion without destruction of said security device.

7. The system of claim 6, wherein the frame includes a slotted portion for receiving one of said male portion and said female portion of said security device.

8. The system of claim 7, wherein said male portion includes: a head; and a shaft inserted through said hole in the cover, said female portion being positioned proximate said slotted portion, said shaft traversing a portion of said slotted portion and engaging said female portion.

9. A secure manhole cover and manhole frame system comprising:

at least one security device securing the cover to the frame, the cover including at least one hole through which a corresponding one of said at least one security device traverses, said at least on security device including:

a male portion including a head and a shaft inserted through said hole in the cover; and a female portion receiving said male portion, said security device not releasing said male portion from said female portion without destruction of said security device, the frame includes a slotted portion for receiving one of said male portion and said female portion of said security device, said female portion being positioned proximate said slotted portion, said shaft traversing a portion of said slotted portion and engaging said female portion; said frame further includes a pocket in communication with said slotted portion, said pocket holding said female portion in position to receive said shaft.

10. A manhole security system, comprising:

a cover including an opening;

a frame receiving said cover, said frame including a pocket; and at least one security device including:

a lock body being positioned in said pocket; and a shaft with a head attached to one end thereof, said shaft positioned through said opening and connected to said lock body.

* * * * *